United States Patent [19]

Wada et al.

[11] Patent Number: 4,598,237

[45] Date of Patent: Jul. 1, 1986

[54] POWER WINDOW CONTROL APPARATUS

[75] Inventors: Kiyoshi Wada; Hitoshi Takeda; Hiroki Shibata; Atsushi Toda; Nobumi Yokoyama; Naohiro Yamada, all of Tokyo, Japan

[73] Assignee: Koito Manufacturing Co., Ltd., Tokyo, Japan

[21] Appl. No.: 747,157

[22] Filed: Jun. 20, 1985

[30] Foreign Application Priority Data

| | | | |
|---|---|---|---|
| Jun. 29, 1984 | [JP] | Japan | 59-133043 |
| May 24, 1985 | [JP] | Japan | 60-110125 |
| May 24, 1985 | [JP] | Japan | 60-110126 |
| May 24, 1985 | [JP] | Japan | 60-110127 |

[51] Int. Cl.[4] ..... H02P 1/22

[52] U.S. Cl. ..... 318/16; 318/293; 318/480

[58] Field of Search ..... 318/640, 480, 16, 256, 318/281, 467, 469, 282, 293; 307/10 R

[56] References Cited

U.S. PATENT DOCUMENTS

| | | | |
|---|---|---|---|
| 4,247,806 | 1/1981 | Mercier | 318/469 X |
| 4,357,564 | 11/1982 | Deming | 318/256 X |
| 4,371,814 | 2/1983 | Hannas | 318/480 |
| 4,373,149 | 2/1983 | Coste | 318/281 |
| 4,385,296 | 5/1983 | Tsubaki et al. | 318/16 X |
| 4,467,249 | 8/1984 | Swearingen | 318/16 X |
| 4,471,275 | 9/1984 | Comeau | 318/480 X |
| 4,536,687 | 8/1985 | Kurihara et al. | 318/480 |

*Primary Examiner*—B. Bobeck

*Attorney, Agent, or Firm*—Townsend and Townsend

[57] ABSTRACT

A power window control apparatus has a transmitter, detachably mounted to a fixed member in a compartment, for transmitting coded infrared ray signals corresponding to opening/closing operations of right and left windows of a vehicle and a receiver fixed in the compartment, the receiver being provided with a manual switch for driving the relay circuit independently of the signal from the transmitter, a reset circuit for resetting the decoder for a predetermined period of time after an ignition switch is turned on, and a braking circuit for braking a corresponding one of motors when a driver releases a transmitter switch.

8 Claims, 14 Drawing Figures

POWER WINDOW CONTROL APPARATUS

BACKGROUND OF THE INVENTION

The present invention relates to a power window control apparatus.

Electronic power window mechanisms for opening/-closing window glass with switching operation have been recently preferred. Demand has arisen for modifying a manual window mechanism to a power window mechanism. For this purpose, a window glass opening/-closing motor is mounted and electric wires are connected between the motor and switches arranged on a door.

In order to control motor rotational directions, five wires including the power supply lines and control lines must be connected. These wires are thick and cannot be fitted in conventional doors. The wires run inside the vehicle compartment, resulting in poor appearance.

The switch for opening/closing the window is normally mounted on the arm rest. When a child rides at the window side, he or she touches the switch and the window is accidentally closed. The child may get hurt when he or she is sandwiched between the window glass and the window frame. Under these circumstances, the switches must be concentrated and arranged at the center of the compartment.

For this reason, only the power supply wires can be connected to the motor, and a control unit can be arranged substantially at the center of the compartment to control the rotational direction of the motor. However, in order to separately open/close the front and rear windows, eight switches are required. It is difficult to arrange such a large number of switches in the narrow compartment. When the number of switches is increased, the operation becomes cumbersome, resulting in inconvenience.

Demand has arisen for a compact power window control apparatus which is simply operated and safe without operation errors.

SUMMARY OF THE INVENTION

It is an object of the present invention to provide a power window control apparatus which does not require a large mounting space and can be easily and safely operated.

In order to achieve the above object of the present invention, there is provided a power window control apparatus comprising a transmitter, detachably mounted to a fixed member in a compartment, for transmitting coded infrared ray signals corresponding to opening/closing operations of right and left windows of a vehicle and a receiver fixed in the compartment, said receiver being provided with a photosensor for receiving a transmission signal from the transmitter, an amplifier, a detector, a decoder for decoding a signal detected by the detector and generating an output signal corresponding to a content of the detected signal, a relay circuit, opening/closing contacts thereof upon generation of the output from the decoder, for controlling rotation of window opening/closing drive motors, a manual switch for driving the relay circuit independently of the signal from the transmitter, a reset circuit for resetting the decoder for a predetermined period of time after an ignition switch is turned on, and a braking circuit for braking a corresponding one of the motors when a driver releases a transmitter or receiver switch.

DETAILED DESCRIPTION OF THE PREFERRED EMBODIMENTS

Figure 1:
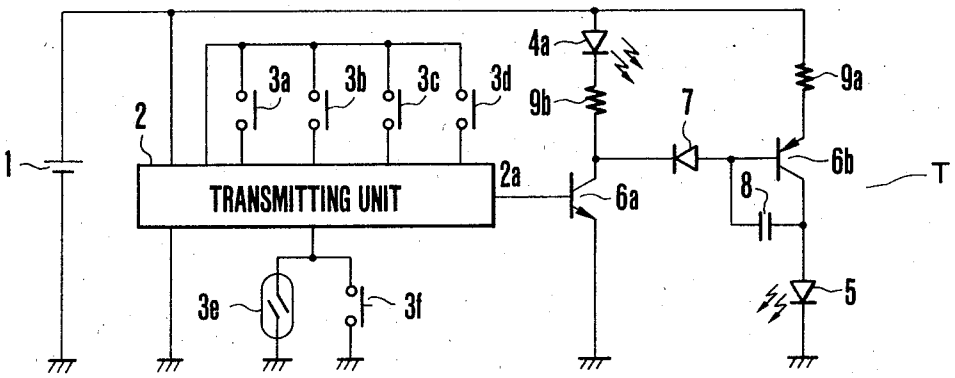
FIGS. 1 and 2 are circuit diagrams of a transmitter and a receiver in a power window control apparatus according to an embodiment of the present invention, respectively.
Figure 2:
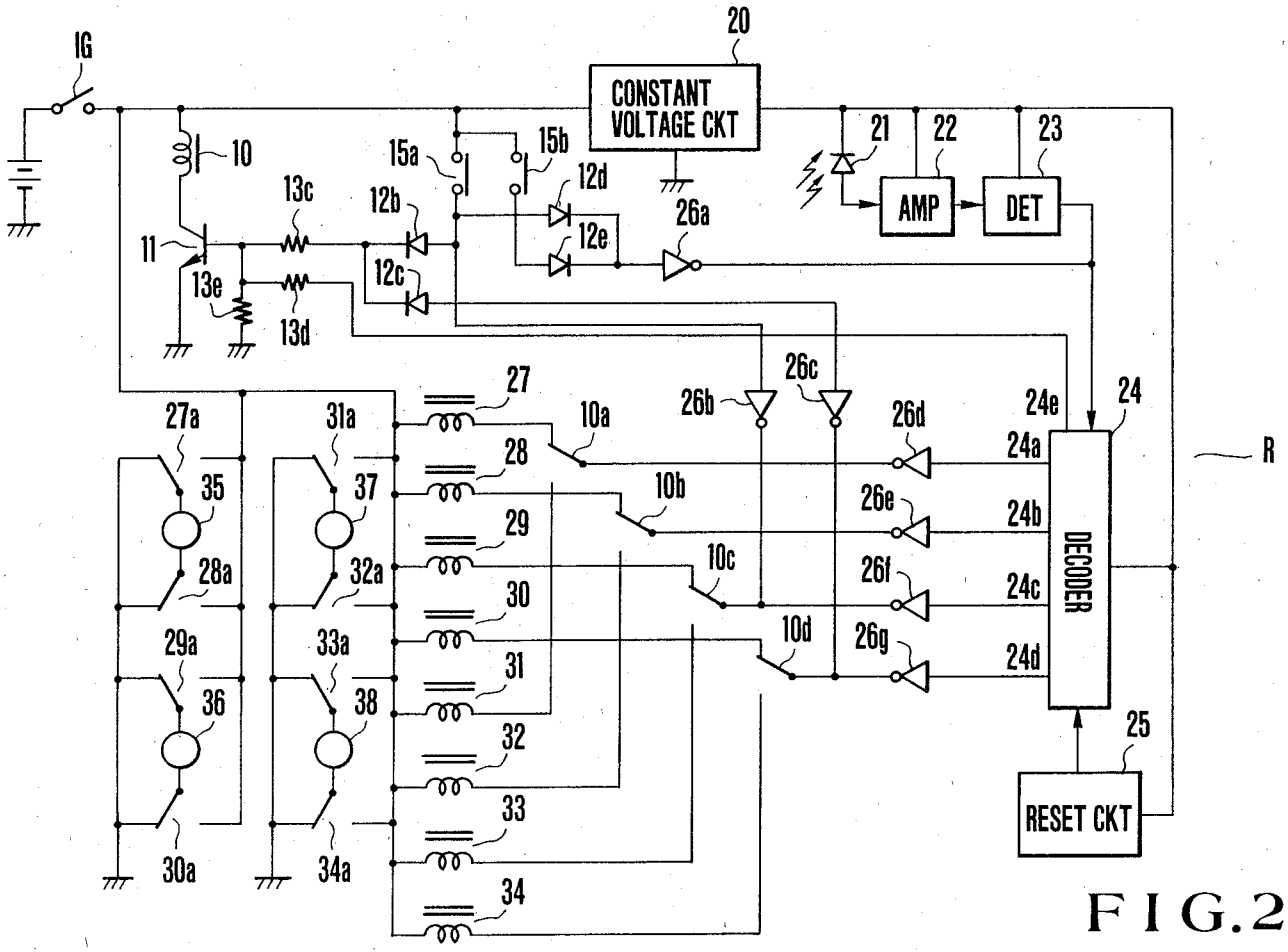

FIGS. 1 and 2 show a power window control apparatus according to an embodiment of the present invention, in which FIG. 1 is a circuit diagram of a transmitter thereof and FIG. 2 is a circuit diagram of a receiver. Referring to FIG. 1, reference numeral 1 denotes a battery; 2, a transmitting unit; 3*a*, 3*b*, 3*c* and 3*d*, switches for opening/closing side door windows, respectively; 4*a*, an infrared ray light-emitting diode; 5, a transmission indicator light-emitting diode; 6*a* and 6*b*, transistors, respectively; 7, a diode; 8, a capacitor; and 9*a* and 9*b*, resistors, respectively. The transmitting unit 2 generates a code signal corresponding to an operated one of the switches 3*a* to 3*d* from a terminal 2*a*. The switch 3*a* is used to open the left door glass window, the switch 3*b* is used to close the left door glass window, the switch 3*c* is used to open the right door glass window, and the switch 3*d* is used to close the right door glass window.

Referring to FIG. 2, reference numeral 10 denotes a relay; 10*a* to 10*d*, contacts of the relay 10, respectively; 11, a transistor; 12*b* to 12*e*, diodes, respectively; 13*c*, 13*d* and 13*e*, resistors, respectively; and 15*a* and 15*b*, switches, respectively. The relay 10, the transistor 11, the diodes 12*b* to 12*e*, the resistors 13*c*, 13*d* and 13*e*, and the switches 15*a* and 15*b* constitute a switching circuit for switching for the front and rear door glass window opening/closing control signals. Reference numeral 20 denotes a constant voltage circuit; 21, a light-receiving photodiode; 22, an amplifier; 23, a detector; 24, a decoder; 25, a reset circuit; 26*a* to 26*g*, inverters, respectively; 27, 28, 29, 30, 31, 32, 33 and 34, relays, respectively; and 27*a*, 28*a*, 29*a*, 30*a*, 31*a*, 32*a*, 33*a* and 34*a* contacts of the relays 27 to 34. Reference numerals 35 to 38 denote motors. The motor 35 is used to open/close the rear left door glass window, the motor 36 is used to open/close the rear right door glass window, the motor 37 is used to open/close the front left door glass window, and the motor 38 is used to open/close the front right door glass window. When the signal supplied from the detector 23 represents opening of the left door glass window, the decoder 24 generates a signal of logic "1" at a terminal 24*a* thereof. However, when the signal from the detector 23 represents closing of the left door glass window, the decoder 24 generates a signal of logic "1" at a terminal 24*b* thereof. When the signal represents opening of the right door glass window, the decoder 24 generates a signal of logic "1" at a terminal 24*c* thereof. When the signal represents closing of the right door glass window, the decoder 24 generates a signal of logic "1" at a terminal 24*d* thereof. A terminal 24*e* will be described later.

Figure 3:
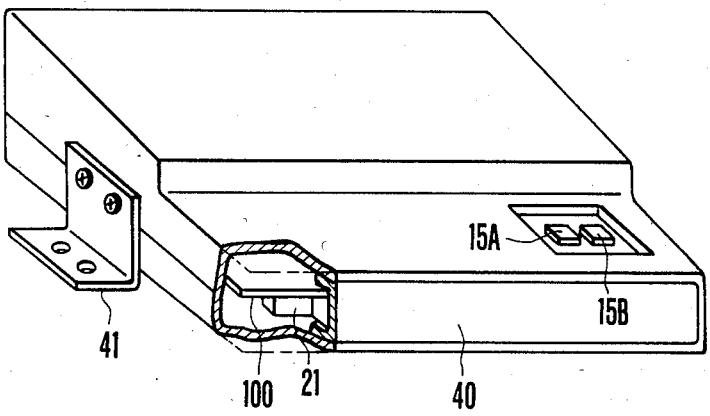
FIG. 3 is a partially cutaway perspective view of the receiver.

FIG. 3 is a perspective view of a receiver R mounted on a dash board or the like. Referring to FIG. 3, buttons 15A and 15B are depressed to turn on the switches 15*a* and 15*b*, respectively. The buttons 15A and 15B are normally housed in recesses and cannot be accidentally touched. Reference numeral 40 denotes an infrared filter. Reference numeral 21 denotes an infrared ray sensor fixed on a printed circuit board 100 in the infrared filter 40. Reference numeral 41 denotes a mounting bracket.

Figure 4:
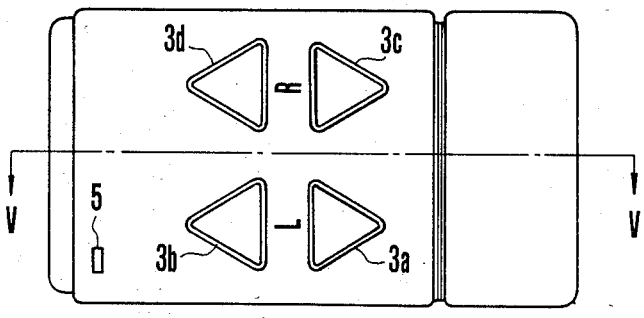
FIG. 4 is a plan view of the transmitter.
Figure 5:
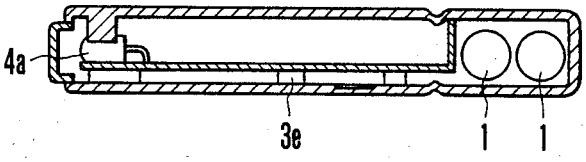
FIG. 5 is a sectional view of the transmitter.

FIG. 4 is a plan view of a transmitter T, and FIG. 5 is a sectional view thereof taken along the line V—V of FIG. 4. In the transmitter T, a reed switch 3*e* is arranged in a position corresponding to a magnet 54 of a holder H.

Figure 6:
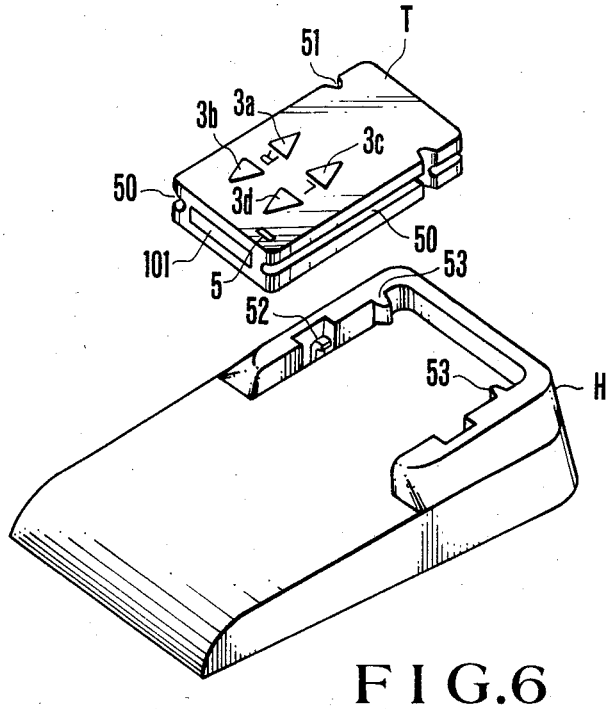
FIG. 6 is a perspective view showing the positional relationship between a holder and the transmitter mounted in the holder.

FIG. 6 shows the holder H mounted on a rear console or the like located between the driver's seat and the front passenger's seat and the transmitter T housed in the holder H. The transmitter T has a mounting groove 50 in a side surface along the longitudinal direction thereof and a positioning groove 51 along a direction of thickness thereof. The groove 50 can engage with an engaging member 52 of the holder H, and the groove 51 can engage with a positioning projection 53, thereby fixing the transmitter T in the holder H. Reference numeral 101 denotes an infrared lens.

Figure 7:
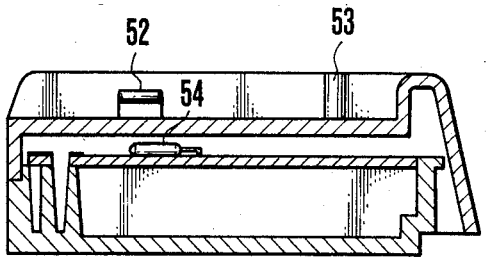
FIG. 7 is a sectional view of the holder.

FIG. 7 is a sectional view of the holder H. Referring to FIG. 7, reference numeral 54 denotes a magnet.

The operation of the power window control apparatus having the arrangement described above will be described hereinafter.

Figure 8:
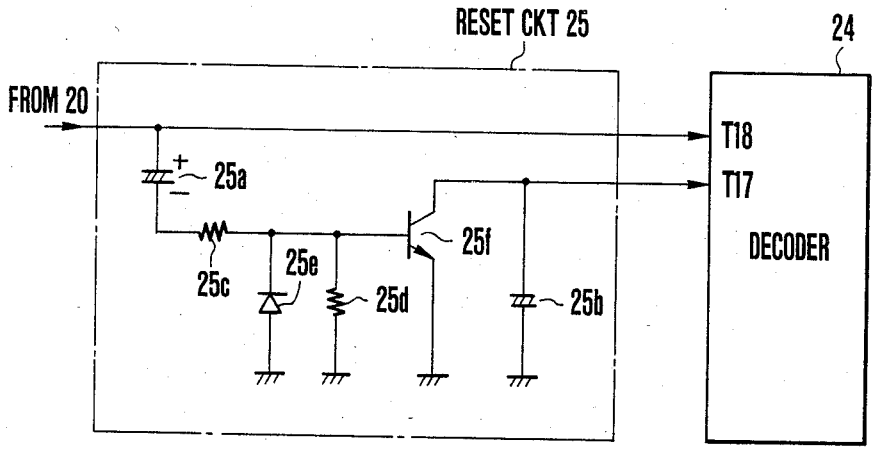
FIG. 8 is a circuit diagram of a reset circuit.

When the ignition switch IG is turned on, a voltage is supplied from a power supply B to the decoder 24 through the constant voltage circuit 20. An input voltage is applied to the reset circuit 25. The reset circuit 25 resets the decoder for a predetermined period of time determined by an RC circuit so as to reset the decoder 24 to the initial state, thereby preventing a power ON error. An arrangement of the reset circuit 25 is illustrated in FIG. 8. Referring to FIG. 8, the constant voltage is supplied from the constant voltage circuit 20 to a terminal T18 and a time constant circuit consisting of a capacitor 25*a* and a resistor 25*c* of the reset circuit 25. As a result, a transistor 25*f* keeps ON state for a time interval determined by the capacitance of the capacitor 25*a* and the resistance of the resistor 25*c*. For this time interval, a terminal T17 of the decoder 24 is held in "L" level, thereby resetting the decoder 24 and preventing an operation error of the receiver upon energization of the apparatus.

When the transmitter T is mounted in the holder H, the reed switch 3*e* of the transmitter T is kept on by the magnet 54 of the holder H. In this state, when the driver depresses the switch 3*a* of the transmitter T to move the left door glass window downward, a code signal representing the ON state of the reed switch 3*e* and corresponding to the function of the switch 3*a* appears at the terminal 2*a* of the transmitting unit 2. The infrared ray is emitted from the light-emitting diode 4*a* in response to the code signal. The infrared ray is received by the photodiode 21 in the receiver R and converted to an electrical signal.

The electrical signal from the photodiode 21 is amplified by the amplifier 22. The amplified signal is detected by the detector 23, and the detected signal is supplied to the decoder 24. In this case, the transmitted signal represents opening of the left door glass window. At the same time, the reed switch 3*e* is kept on. The signal of logic "1" appears at the terminals 24*a* and 24*e* of the decoder 24. As a result, the signal appearing at the terminal 24*e* triggers the transistor 11 which then energizes the relay 10. The contacts 10*a* to 10*d* of the relay 10 are switched in the positions opposite to those illustrated in FIG. 2. The signal appearing at the terminal 24*a* drives the relay 31 through the inverter 26*d*, so that the motor 37 is rotated to open the front left door glass window.

When the switch 3*b* of the transmitter T is depressed to close the front left door glass window, a detection signal appears at the terminal 24*b* of the decoder 24 to drive the relay 32. The motor 37 is rotated in the reverse direction to close the front left door glass window. Similarly, when the switch 3*c* of the transmitter T is depressed, the relay 33 is driven to open the front right door glass window. When the switch 3*d* is depressed, the relay 34 is driven to close the front right door glass window.

When the transmitter T is removed from the holder H, the reed switch 3*e* is turned off. In this state, when a switch of the transmitter T is depressed, the signal of logic "1" does not appear at the terminal 24*e* of the decoder. The relay 10 is not energized. The signals appearing at the terminals 24*a* to 24*d* drive the relays 27 to 30, respectively, to rotate the motor 35 or 36, so that glass window opening/closing control of the rear doors is started. In this case, the switch 15*a* or 15*b* is operated, the relay 10 is turned on, and the contacts 10*a* to 10*d* are set in positions opposite to those illustrated in FIG. 2. The signal of the operated switch is supplied to the output of the detector 23 through the inverter 26*a* to block the output signal of the detector 23. Therefore, the signal from the transmitter T will not be received. For this reason, the front door glass window control wherein the driver operates the switch 15*a* or 15*b* has a priority over the control of the transmitter T. The signal generated through the inverter 26*b* or 26*c* drives the relay 33 or 34. The front right door window, i.e., the driver's seat glass window can be opened/closed irrespective of the operation of the transmitter T.

The transmitter T has a transmission indicator light-emitting diode 5. When any one of the switches 3*a* to 3*d* is depressed, the diode 5 is turned on. For this reason, when the driver visually checks the ON/OFF state of the diode 5, he can check whether the transmitter T is normally operated.

In such an apparatus, when the battery is almost dead, the transmitting output is decreased. In this case, when the transmitter is located near the receiver, the transmitter can be properly operated. For this reason, the transmitter must be removed from the holder. Even in this state, the nonlocking pushbutton can be arranged in parallel with the reed switch 3*e* to perform the opening/closing control of the front door glass windows.

The transmitter can be used without paying attention to the current position of the switch.

In operation, when the depressed switch in the transmitter is released during upward or downward movement of the glass window, the infrared ray is not generated. The operated ones of the relays 27 to 34 restore the state shown in FIG. 2. As a result, the operated motors are braked and immediately stopped.

According to the above embodiment, the front and rear seat passengers can easily remote control opening/-closing of the glass windows with the transmitter T. In addition, the front glass windows can be opened or closed by the switches 15*a* and 15*b* in the receiver R irrespective of the operation of the transmitter T. In the conventional power window mechanism, a total of three wires is required for the power source and control lines. These lines are powered with a large current and must therefore be thick. These thick lines cannot be easily installed in the doors. However, according to the present invention, only the power source lines are connected to the motor, so that the wires can be easily installed in the door. Furthermore, a space for switch installation can be minimized.

Furthermore, the decoder 24 in the receiver R is reset after the ignition switch is turned on, thereby guaranteeing stable operation.

Furthermore, since the receiver R is operated only after the ignition switch is turned on, the windows cannot be opened or closed by another transmitter of the same type. Therefore, theft and other pranks can be completely prevented.

The controller for opening or closing the glass window is arranged substantially at the center of the compartment. Even if a child accidentally operates the switch, he will not be sandwiched between the window glass and the window frame.

Furthermore, when the operator releases a finger from the operated switch for opening/closing glass window, the corresponding motor is braked and stopped, thereby guaranteeing safe operation.

Figure 9:
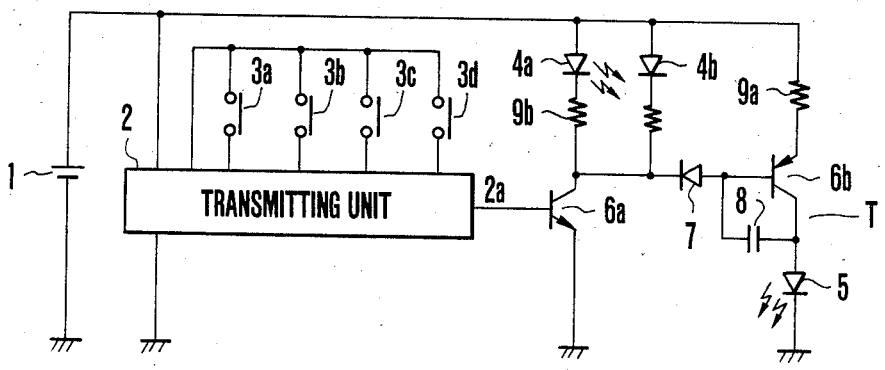
FIGS. 9 and 10 are circuit diagrams of a transmitter and a receiver in a power window control apparatus according to another embodiment of the present invention, respectively.
Figure 10:
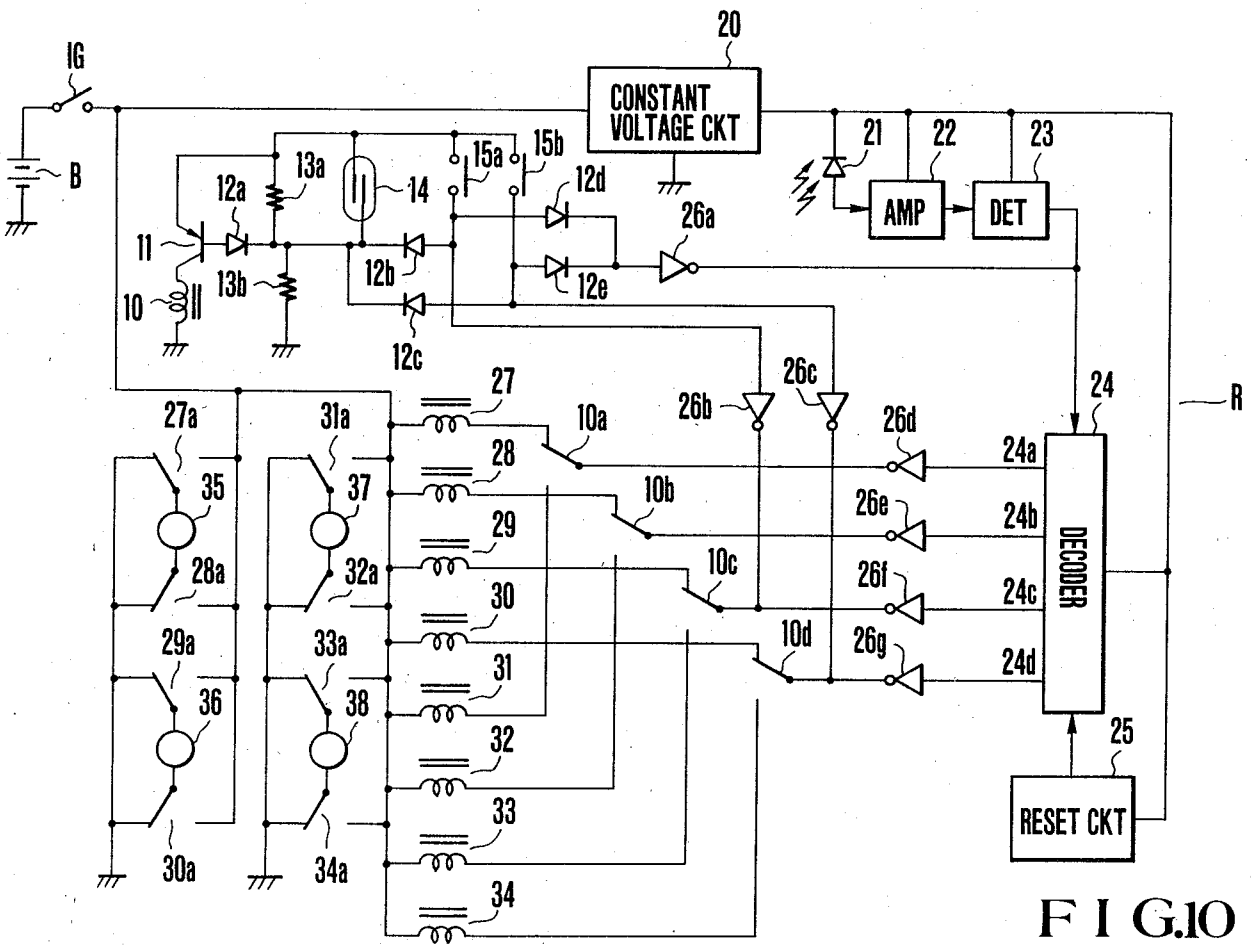

FIGS. 9 and 10 are circuit diagrams showing a transmitter T and a receiver R, respectively, in a power window control apparatus according to another embodiment of the present invention. In this embodiment, the transmitter T can be detachably attached to the receiver R. A reed switch 14 is arranged in the receiver R. When the transmitter T is attached to the receiver R, the reed switch 14 is turned on by a magnet in the transmitter which is located opposite to the reed switch 14. By attachment/detachment of the transmitter, control operations for the front and rear windows can be switched. More specifically, when the transmitter T is mounted on the receiver R, a light-emitting diode 4*b* mounted facing down transmits an infrared signal to the receiver R.

One of the most important issues in the power window control apparatus in the vehicle is to prevent an accident of a child being sandwiched between the window glass and the window frame when he accidentally operates the transmitter.

Figure 11:
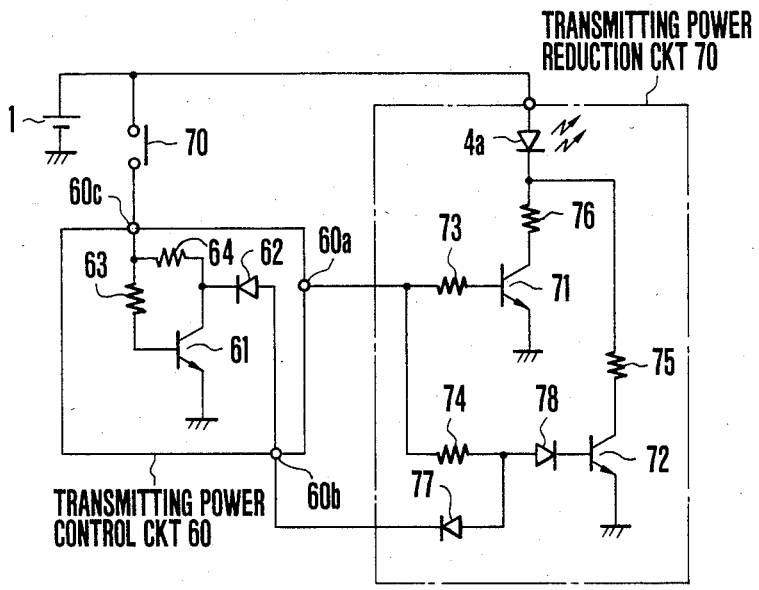
FIGS. 11 and 13 are respectively circuit diagrams of arrangements for decreasing a transmitting output in specific cases.

FIG. 11 is a circuit diagram showing another arrangement of the transmitter in consideration of an accident prevention function.

Referring to FIG. 11, a control signal corresponding to a control item associated with opening/closing of the window is generated from a terminal 60*a* of a transmitting output control circuit 60 in the transmitter T. The terminal 60*a* is connected to the base of a transistor 71 in a transmitting output power reduction circuit 70 through a resistor 73. The collector of the transistor 71 is connected to the light-emitting diode 4*a* through a resistor 76.

The control circuit 60 also has terminals 60*b* and 60*c*. The terminal 60*c* is connected to the collector of the transistor 61 and to the base thereof through the resistor 63. The collector of the transistor 61 is also connected to the terminal 60*b* through a diode 62. The terminal 60*b* is connected to the base of a transistor 72 through diodes 77 and 78 which are reverse biased with each other. A common junction between the diodes 77 and 78 is connected to the terminal 60*a* through a resistor 74. The collector of the transistor 72 is connected to the light-emitting diode 4*a* through a resistor 75. The terminal 60*c* of the transmitting output control circuit 60 is connected to a power supply 1 through the switch 70.

The switch 70 is turned on when a specific signal, e.g., a control signal for moving the window downward is generated from the light-emitting diode 4*a*. For example, when the switch 3*a* or 3*c* is depressed as in the previous embodiment, the switch 70 is turned on. When the switch 70 is turned on, the transistor 61 is turned on, so that a signal of "L" level is generated from the terminal 60*b* through the diode 62.

When a window is to be opened, the switch 70 is kept off, and the terminal 60*b* is kept at "H" level. In this case, the transistor 72 is turned on/off together with the transistor 76. A current flowing in the light-emitting diode 4*a* is determined by resistances of the resistors 75 and 76. When the resistance of the resistor 75 is set to be sufficiently smaller than that of the resistor 76, a current flowing through the light-emitting diode 4*a* is substantially controlled by the resistor 75. Infrared output energy for opening the window is high.

When specific control, e.g., window closing control is to be performed, the switch 70 is turned on, and the terminal 60*b* of the transmitting output control circuit 60 is set at "L" level. The transistor 72 is turned off. In this case, a current flowing through the light-emitting diode 4*a* is determined by the resistance of the resistor 76. Therefore, infrared output energy can be decreased.

Figure 12:
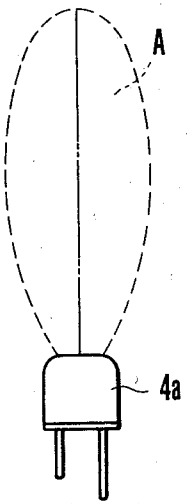
FIG. 12 is a diagram showing an infrared ray from a light-emitting diode.

The infrared ray emitted from the light-emitting diode 4*a* has directivity indicated by the broken line of FIG. 12. For this reason, in order to close the glass window, the infrared energy is determined such that the infrared ray is received by the photodiode (not shown) only when a major optical axis A of the diode 4*a* is directed to the photodiode, and that the infrared ray emitted from any direction can be received in other control operations. The window glass closing control is invalid when the infrared ray is accidentally emitted in a direction except for the photodiode direction, thereby guaranteeing safe operation.

Figure 13:
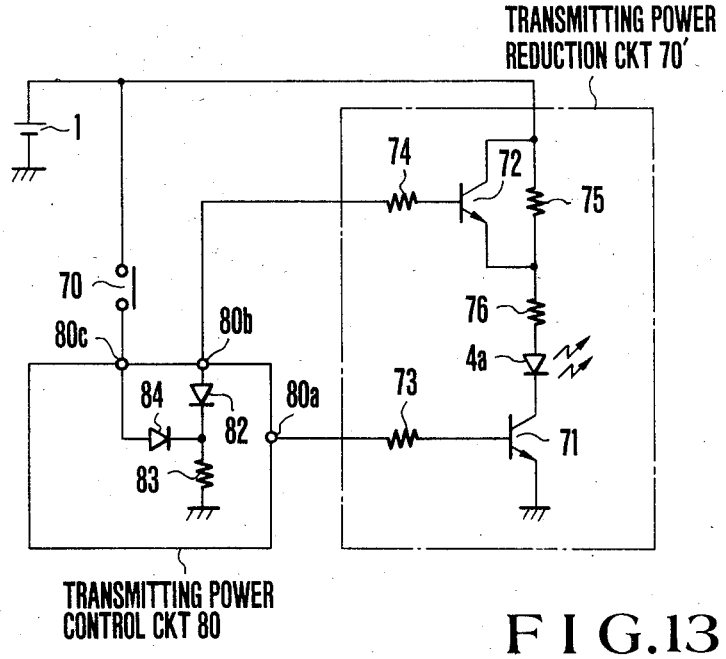

FIG. 13 is a circuit diagram showing another arrangement for reducing the transmitting output. The same reference numerals as in FIG. 13 denote the same parts as in FIG. 11. In the same manner as the circuit of FIG. 11, in order to open the glass window, resistances of resistors 75 and 76 are determined such that a large current flows in an infrared light-emitting diode 4*a* when transistors 71 and 72 are turned on, and that a small current flows in the light-emitting diode 4*a* during window glass closing control. Reference numeral 84 denotes a diode.

The specific control operation is exemplified by the window glass closing control operation. However, this control operation may be replaced with a control operation for opening/closing the driver's seat glass window. In this case, the photodiode is arranged near the dashboard. For specific control, infrared energy can be determined such that the infrared ray emitted from the driver's seat can be detected by the photodiode but the infrared ray emitted away from the driver's seat cannot be detected.

In the above embodiment, infrared ray energy is decreased for specific control. Even if specific control is accidentally performed, the control operation will not be valid. When specific control is important, an accidental operation will not cause an unexpected accident, thereby guaranteeing safe operation.

Figure 14:
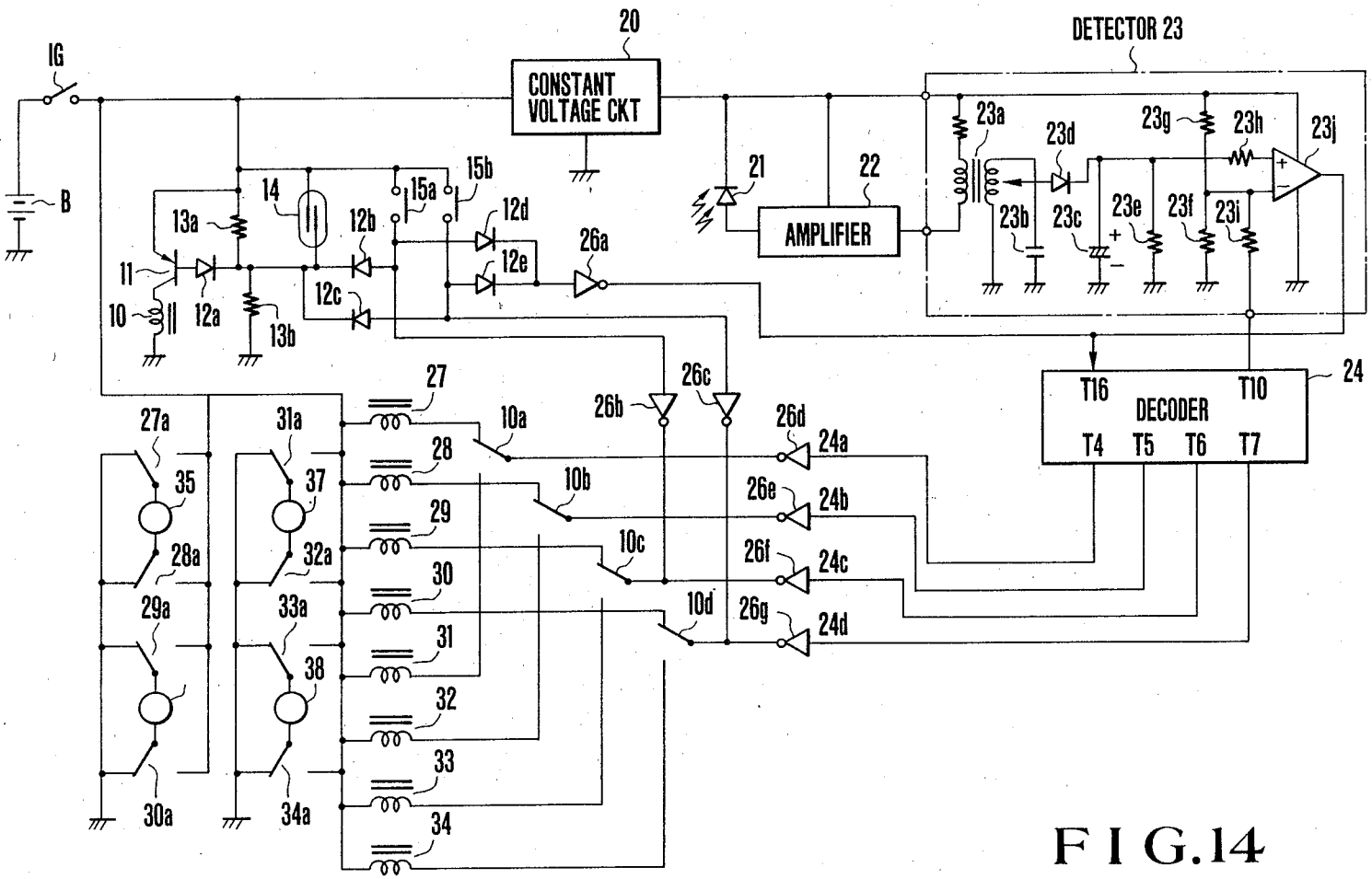
FIG. 14 is a circuit diagram showing an arrangement of the receiver for decreasing a receiving sensitivity in a specific case.

FIG. 14 shows an arrangement of a receiver R in consideration of a child accident prevention function. The same reference numerals in FIG. 14 denote the same components as in FIG. 2.

In the receiver R, a detector 23 has a transformer 23*a* connected to an output of an amplifier 22. A capacitor 23*b* is connected to two ends of the secondary winding of the transformer 23*a*. The center tap of the secondary winding is connected to the input of a diode 23*d*. A capacitor 23*c* and a resistor 23*e* are connected in parallel with each other between the output terminal of the diode 23*d* and ground. The output terminal of the diode 23*d* is connected to the noninverting input terminal (+) of an operational amplifier 23*j* through a resistor 23*h*. The inverting input terminal (−) of the operational amplifier 23*j* is connected to an output terminal T10 of the decoder 24 through a resistor 23*i*. The operational amplifier 23*j* constitutes a comparator which compares the noninverted input signal with the inverted input signal and which generates an output representing a difference between the noninverted and inverted input signals. The output from the comparator 23*j* is supplied together with the output from the inverter 26*a* to a terminal 16 of the decoder 24.

A level shift signal appears at the output terminal T10 while the specific signal, e.g., the control signal for closing the window glass is received at the terminal T16 of the decoder 24. The level of the level shift signal is set to cause the comparator 23*j* to detect a signal received at the noninverting input terminal thereof only when the axis (A in FIG. 12) of the infrared ray emitted from the light-emitting diode 4*a* in the transmitter T is located near the center of the reception beam of a photodiode 21. The operation of the power window control apparatus having the arrangement described above will be described hereinafter.

When the switch 3*a* or 3*c* (FIG. 1) in the transmitter T is depressed to open the window glass, a code signal corresponding to the function of the depressed switch is generated from the light-emitting diode 4*a* and is received by the photodiode 21 in the receiver R. An electrical signal from the photodiode 21 is amplified by an amplifier 22. The amplified signal is supplied to the noninverting input terminal of the comparator 23*j* in the detector 23. Since this input signal does not represent a specific control signal (e.g., a signal representing closing of the window), the terminal T10 of the decoder 24 is kept at "L" level. When the detection level of the comparator 23*j* is determined such that the resistances of the resistors 23*f*, 23*g* and 23*i* maximize the receiver sensitivity, the reception signal can be determined even if the central direction A of the beam from the light-emitting diode 4*a* is not directed toward the receiver R, i.e., even if the reception input level is low.

When the switch 3*b* or 3*d* in the transmitter T is depressed to close the window, the control signal is the specific signal. In this case, the signal having the predetermined level as described above is generated from the terminal T10 of the decoder 24. As a result, the detection level of the comparator 23*j* is increased. Only when the center of the infrared ray from the light-emitting diode 4*a* is accurately directed toward the photodiode 21 in the receiver R, the input can be detected. When the same subsequent signal is received from the transmitter, the signal of "H" level from the output terminal T4 or T6 of the decoder 24 causes the motor to rotate so as to close the window. When the transmitter T is operated to close the window glass, the transmitter is operated while it is accurately directed toward the receiver, thereby closing the window glass. However, when a child accidentally plays with the transmitter T, the infrared ray from the transmitter T is not accurately directed toward the receiver R. In this manner, the window is not closed, thereby guaranteeing safe operation.

The above operation is neglected when the driver operates the switch 15*a* or 15*b* to open/close the driver's seat window glass since the "L" level signal is supplied from the inverter 26*a* to the terminal T16 of the decoder 24.

Various combinations of circuit arrangements, structures and mounting modes of the transmitter T and the receiver R in each embodiment described above can be proposed.

Since the infrared ray has strong directivity and large attenuation, no interference will be effected by electromagnetic induction or the like. Therefore, the infrared signal can be optimally used for a vehicle transmitter T.

What is claimed is:

1. A power window control apparatus comprising a transmitter, detachably mounted to a fixed member in a compartment, for transmitting coded infrared ray signals corresponding to opening/closing operations of right and left windows of a vehicle and a receiver, fixed in the compartment, for receiving the infrared ray signal from said transmitter and provided with a photosensor for receiving a transmission signal from said transmitter, said receiver being further provided with an amplifier for amplifying an output signal from said photosensor, detector means for detecting an output signal from said amplifier, a decoder for decoding a signal detected by said detector means and generating an output signal corresponding to a content of the signal received from said transmitter, a relay circuit, opening/closing contacts thereof upon generation of the output from said decoder, for controlling rotation of window opening/closing drive motors, a manual switch for driving said relay circuit independently of the signal from said transmitter, a reset circuit for resetting said decoder for a predetermined period of time after an ignition switch is turned on, and a braking circuit for braking to rapidly stop a corresponding one of said motors by forming a short circuit when a driver releases a transmitter or receiver switch.

2. An apparatus according to claim 1, wherein said transmitter comprises display means for indicating transmission operation.

3. An apparatus according to claim 1, wherein said transmitter comprises transmitting power reduction means for reducing an output when a specific code is transmitted.

4. An apparatus according to claim 1, wherein said decoder in said receiver transmits a control signal to said detector means when a specific signal is received, and a sensitivity of said detector means is decreased in response to the control signal from said decoder.

5. An apparatus according to claim 1, wherein said fixed member for detachably mounting said transmitter comprises said receiver.

6. An apparatus according to claim 1, wherein said fixed member for detachably mounting said transmitter comprises a holder mounted near a driver's seat.

7. An apparatus according to claim 5 or 6, wherein said fixed member comprises a magnet, and said transmitter comprises a switch which is turned on/off by said magnet upon attachment/detachment of said transmitter so as to select the window to be opened/closed.

8. An apparatus according to claim 5, wherein said receiver comprises a magnet, and said transmitter comprises a switch which is turned on/off by said magnet upon attachment/detachment of said transmitter so as to select the window to be opened/closed.

* * * * *